US007409841B2

(12) United States Patent
Oh et al.

(10) Patent No.: US 7,409,841 B2
(45) **Date of Patent: *Aug. 12, 2008**

(54) CONTROL PANELS FOR DRUM TYPE WASHING MACHINE AND DRYER

(75) Inventors: Min Jin Oh, Changwon-si (KR); In Haeng Cho, Changwon-si (KR)

(73) Assignee: LG Electronics Inc., Seoul (KR)

( * ) Notice: Subject to any disclaimer, the term of this patent is extended or adjusted under 35 U.S.C. 154(b) by 522 days.

This patent is subject to a terminal disclaimer.

(21) Appl. No.: 10/720,346

(22) Filed: Nov. 25, 2003

(65) Prior Publication Data

US 2004/0163424 A1 Aug. 26, 2004

(30) Foreign Application Priority Data

Nov. 26, 2002 (KR) ..... 10-2002-0073894

(51) Int. Cl.
*D06F 33/00* (2006.01)

(52) U.S. Cl. ..... 68/12.23; 68/12.01; 68/12.27

(58) Field of Classification Search ..... 68/12.23, 68/12.01, 12.27
See application file for complete search history.

(56) References Cited

U.S. PATENT DOCUMENTS 4,510,778 A * 4/1985 Cotton ..... 68/12.15
5,350,140 A * 9/1994 Ripley et al. ..... 248/27.1
6,523,205 B1 * 2/2003 Broker et al. ..... 8/158
6,654,975 B2 * 12/2003 Broker ..... 8/159
2003/0196460 A1 * 10/2003 Lyu et al. ..... 68/13 R

FOREIGN PATENT DOCUMENTS

CA 2330236 * 11/2001

* cited by examiner

*Primary Examiner*—Michael Barr
*Assistant Examiner*—Jason Heckert
(74) *Attorney, Agent, or Firm*—Birch, Stewart, Kolasch & Birch, LLP

(57) ABSTRACT

Control panels for a drum type washing machine, and a dryer including a first control panel mounted on a position for a drum type washing machine or a dryer, having a key part for applying a command for controlling the drum type washing machine or the dryer, and a display part for displaying an image in accordance with the command applied through the key part, a second control panel mounted on a position for the drum type washing machine or the dryer in symmetry with the first control panel, having a key part for applying a command for controlling the drum type washing machine or the dryer, and a display part for displaying an image in accordance with the command applied through the key part, in symmetry with the key part, and the display part in the first control panel respectively, and a first, and a second controlling parts connected to the first control panel or the second control panel, for controlling operation of the appliances according to the command of the user applied through the first control panel or the second control panel.

10 Claims, 6 Drawing Sheets

CONTROL PANELS FOR DRUM TYPE WASHING MACHINE AND DRYER

This application claims the benefit of the Korean Application No. P2002-0073894 filed on Nov. 26, 2002, which is hereby incorporated by reference.

BACKGROUND OF THE INVENTION

1. Field of the Invention

The present invention relates to drum type washing machines and dryers, and more particularly, to control panels for a drum type washing machine and a dryer.

2. Background of the Related Art

In general, the washing machine washes laundry by carrying out washing, rinsing, and spinning cycles according to a preset algorithm, and is sorted as a pulsator type, an agitator type, and a drum type. At first, the drum type washing machine will be described. FIG. 1 illustrates a related art drum type washing machine.

Referring to FIG. 1, the related art drum type washing machine is provided with a body 101, a tub 102 fastened to an inside of the body 101 with dampers (not shown), a drum 103 for carrying out a washing related cycle as the laundry is introduced into the tub 102, and the drum 103 receives a driving force of a motor 110 through a belt 111, and rotated thereby, a thermister 104 for measuring a temperature of a washing water supplied to the drum 103, a detergent box 105 for introducing detergent, a water supply pipe 106 connected to the detergent box, for supplying washing water, mixed with or without the detergent, a discharge pipe 107 for discharging the washing water used in a washing cycle to an outside of the washing machine, and a pump 108 and a discharge hose 109 connected to an end of the discharge pipe 107 for forced discharge of the washing water.

The operation of the drum type washing machine will be described.

The user opens a door (not shown) on a front part of the body 101, introduces laundry, and provides a washing command through a control panel. Then, a controlling part (not shown) detects an amount of laundry, i.e., an amount of cloth in the drum 103, and fills the washing water up to a water level set required for the detected amount of cloth through the water supply pipe 106 via the detergent box 105.

When the washing water is filled to a level higher than a preset level, the motor 110 is put into operation, and the drum 103 is rotated, to progress the washing. Then, upon finishing the washing, the pump 108 is put into operation, to discharge the washing water to an outside of the washing machine through the discharge pipe 107 and the discharge hose 109, and, when the discharge of washing water is finished, rinsing, and spinning cycles are carried out in succession, thereby finishing washing.

In the meantime, a laundry dryer, for automatic drying of wet laundry after finish of washing, has a trend of an increasing demand, recently. FIG. 2 illustrates a related art laundry dryer.

Referring to FIG. 2, the related art dryer is provided with a drying chamber 220 in a case 210, an opening 230 in a front part of the case 210 for introducing laundry into the drying chamber 220, and a door 240 on the opening for opening/closing the opening 230. There is a motor 250 in an upper part of the case 210, so that the drying chamber 220 is receives a driving force from the motor 250 through a drying chamber belt 260, and rotated thereby. There are a plurality of fins 270 on an inside wall of the drying chamber 220 for circulating the laundry during rotation of the drying chamber 220.

In the meantime, there is a circulating duct 280 between a rear surface of the drying chamber 220 and the opening 230, for circulating heated air. Of course, at a position thereof, the circulating duct 280 is provided with a heater 212 for heating the air, and a fan 290 for circulating the heated air. In general, the fan 290 is driven by a motor 250 through a belt 211.

The circulating duct 280 has an external air supply duct 213 for supplying external air during the circulation of the air, and a condensed water discharge duct 214 for discharging condensed water formed during circulation of the air, each connected thereto.

The operation of the dryer will be described.

The user opens the door 240, introduces laundry intended to dry into the drying chamber 220, and closes the door 240. If the dryer is put into operation under this state, the motor 250 is started, to rotate the drying chamber 220. In this instance, the laundry is circulated as the laundry is lifted by the fins 270 on an inside surface of the drying chamber 220, and falls down by gravity.

In the meantime, since the rotating force of the motor 250 is transmitted, not only to the drying chamber 220, but also to the fan 290, air circulates through the circulating duct 280, and heated by the heater 212. Accordingly, the heated air supplied to the drying chamber evaporates moisture form the laundry in the drying chamber, thereby drying the laundry.

As described above, since the fan 290 keeps running when the air circulates, and dries the laundry, the external air is supplied to the air circulating duct 280 through the external air supply duct 213 connected to an outside of the dryer. Therefore, the circulating air, and the supplied external air are mixed together, and circulates, and the moisture in the air circulating along the circulating duct 280 is condensed, and discharged to an outside of the dryer through the condensed water discharge duct 214.

Since people in Europe, the USA, Canada, and etc., prefer separate use of the drum type washing machine and the dryer, in most of cases, the drum type washing machine, and the dryer are installed side by side.

In recent preference of home appliances, not only functions of products, but also outer appearances are very important factors, and, accordingly, it is recent trend that manufacturers put much efforts on improving an overall, or partial sense of beauty of the product.

In light of this trend, for a case the drum type washing machine and the dryer are installed side by side, the drum type washing machine and the dryer are manufactured in variety of forms, not only taking a functional aspect, but also the sense of beauty into account.

However, as described before, the related art drum type washing machine and dryer have the following problems.

First, even if the related art drum type washing machine and dryer are installed side by side, operation of the related art drum type washing machine and dryer are controlled separately with respective key operation parts, it has not been convenient for the user to understand the operation states at a look.

Second, since the related art drum type washing machine and dryer are installed side by side, which are manufactured without paying attention to harmony, the outer appearance is poor.

Third, even when positions of the related art drum type washing machine and dryer are exchanged due to gas pipe to the dryer, or other reasons, inconvenience of the user is caused.

SUMMARY OF THE INVENTION

Accordingly, the present invention is directed to control panels for a drum type washing machine and a dryer that substantially obviates one or more of the problems due to limitations and disadvantages of the related art.

An object of the present invention is to provide control panels for a drum type washing machine and a dryer, which enable a user to understand control states of the drum type washing machine and the dryer at a look, when the drum type washing machine and the dryer are installed side by side.

Other object of the present invention is to provide control panels for a drum type washing machine and a dryer, which has a good outer appearance even when the drum type washing machine and the dryer are installed side by side.

Another object of the present invention is to provide control panels for a drum type washing machine and a dryer, which cause no inconvenience in controlling the drum type washing machine and the dryer even if positions of the drum type washing machine and the dryer are exchanged.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the control panels for a drum type washing machine, and a dryer includes a first control panel mounted on a position for a drum type washing machine or a dryer, having a key part for applying a command for controlling the drum type washing machine or the dryer, and a display part for displaying an image in accordance with the command applied through the key part, a second control panel mounted on a position for the drum type washing machine or the dryer in symmetry with the first control panel, having a key part for applying a command for controlling the drum type washing machine or the dryer, and a display part for displaying an image in accordance with the command applied through the key part, in symmetry with the key part, and the display part in the first control panel respectively, and a first, and a second controlling parts connected to the first control panel or the second control panel, for controlling operation of the appliances according to the command of the user applied through the first control panel or the second control panel.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Figure 1:
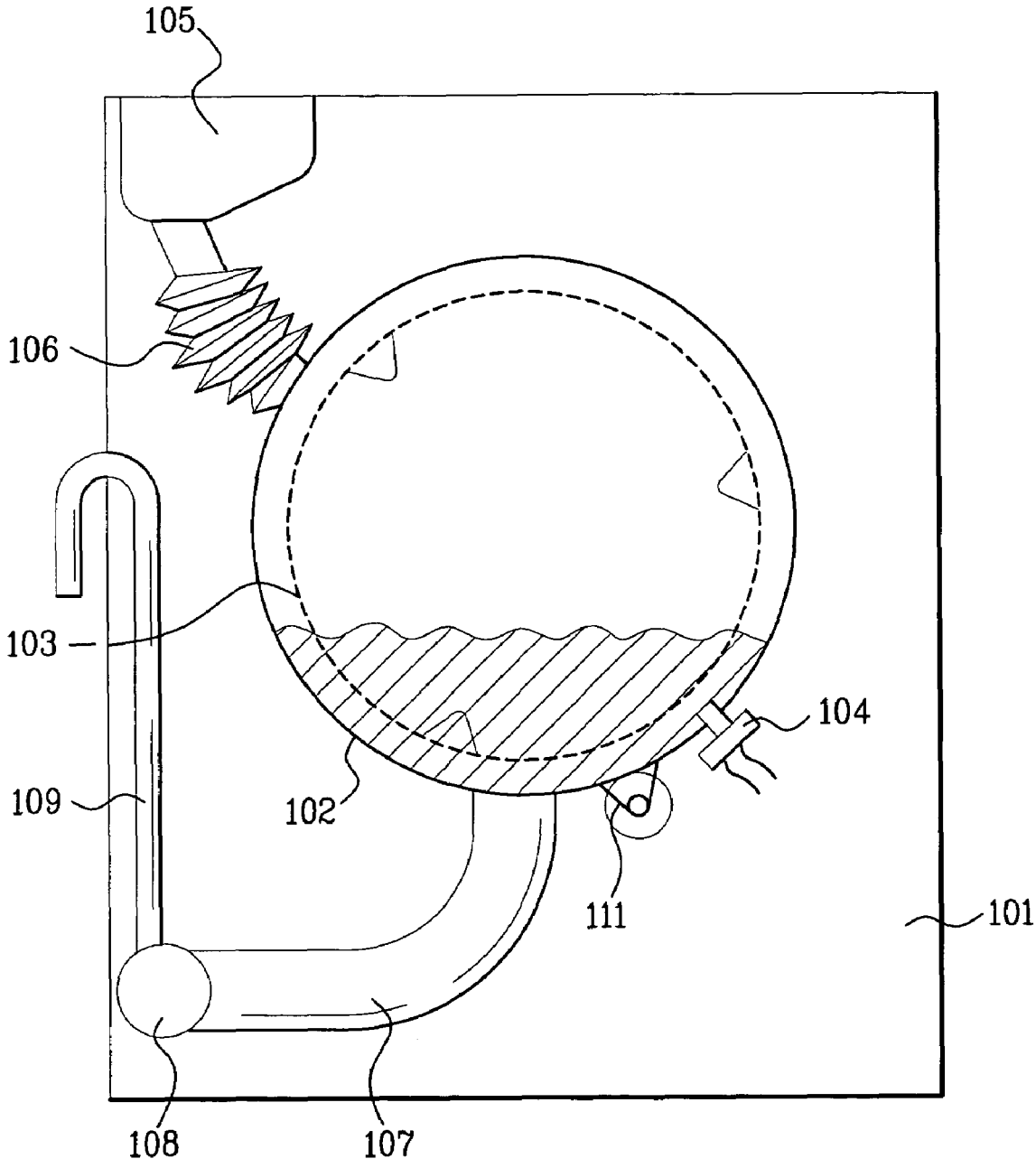
FIG. 1 Prior Art
FIG. 1 illustrates a related art drum type washing machine.
Figure 2:
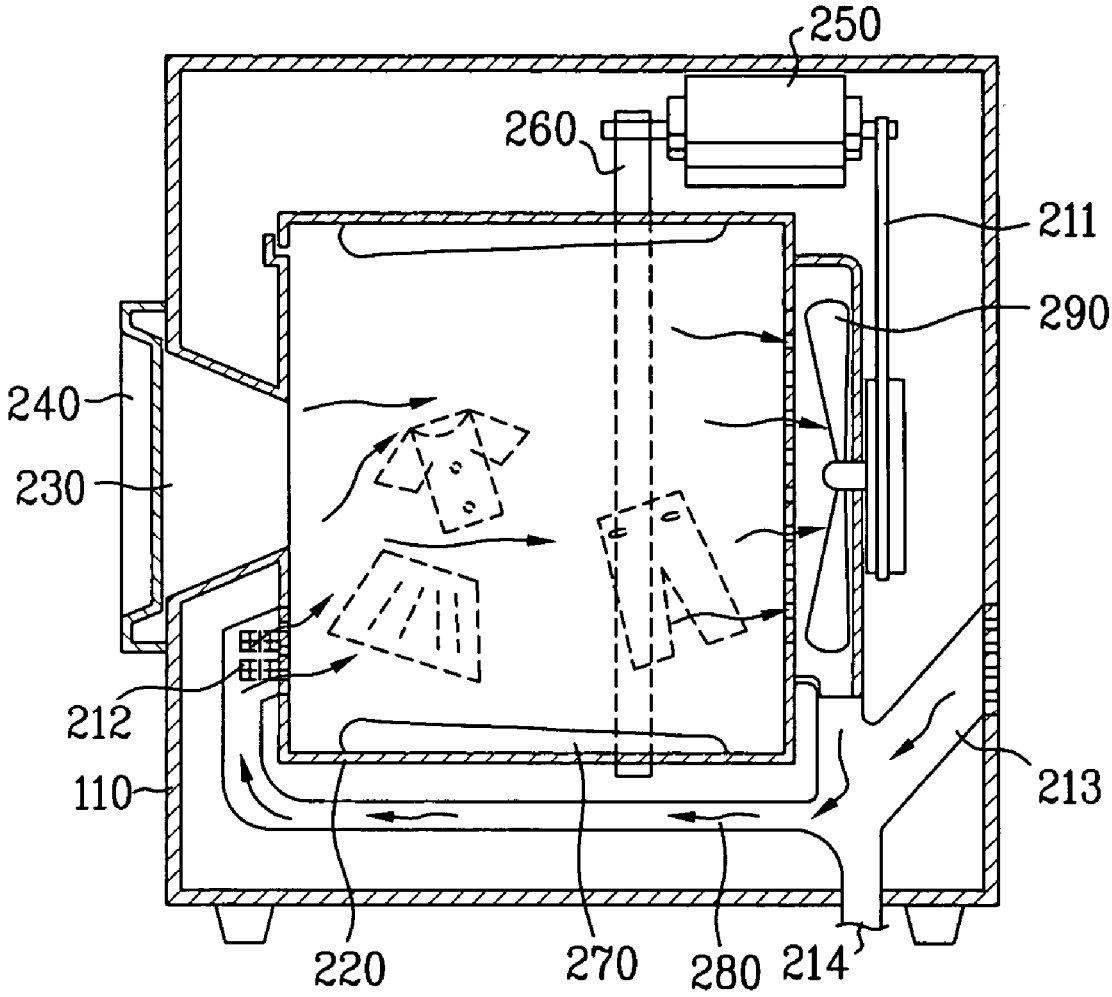
FIG. 2 Prior Art
FIG. 2 illustrates a related art laundry dryer.
Figure 3:
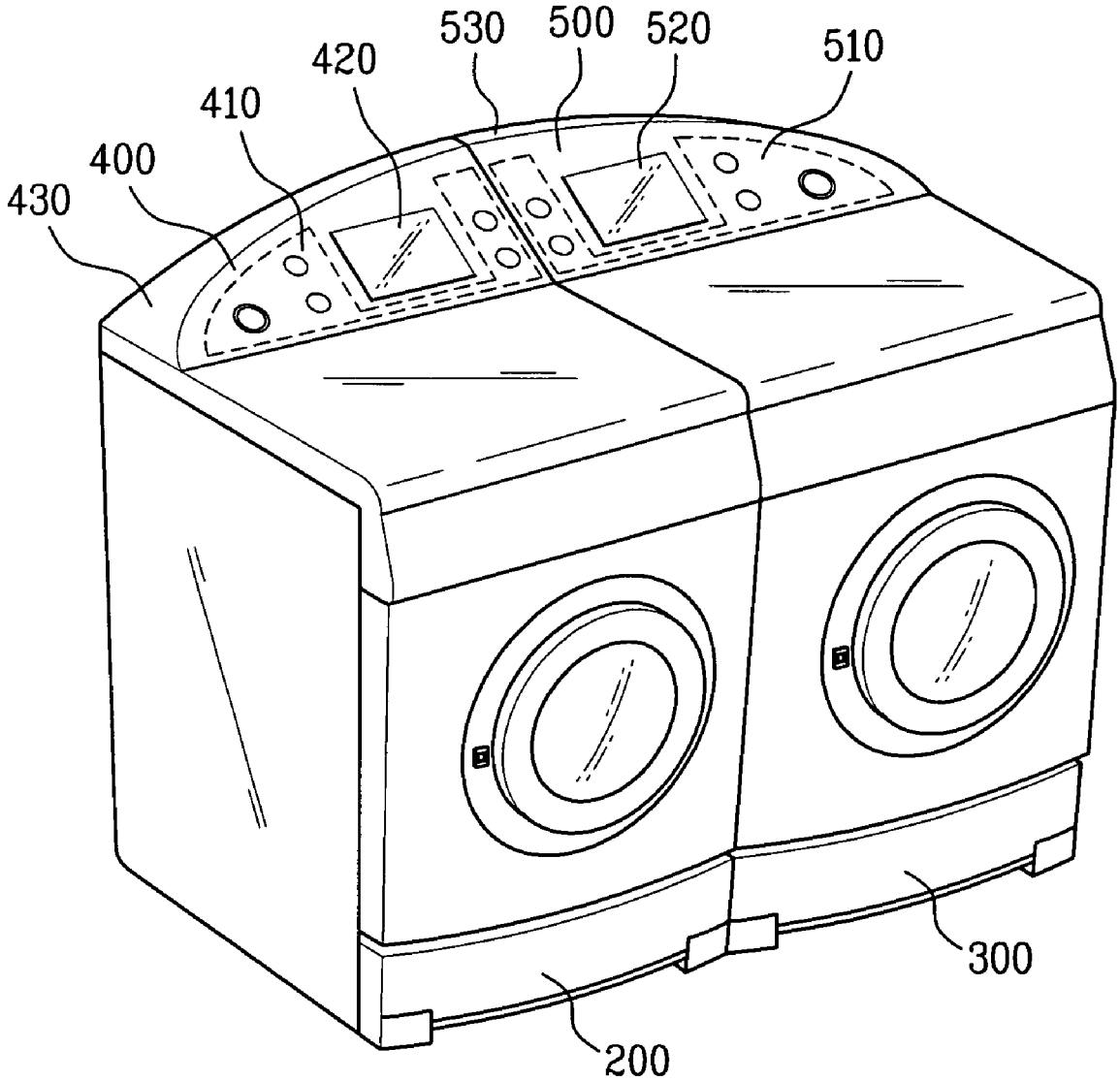
FIG. 3 illustrates a perspective view of a drum type washing machine and a laundry dryer having control panels mounted thereon respectively in accordance with a preferred embodiment of the present invention.

Reference will now be made in detail to the preferred embodiments of the present invention, examples of which are illustrated in the accompanying drawings. FIG. 3 illustrates a perspective view of a drum type washing machine and a laundry dryer having control panels mounted thereon respectively in accordance with a preferred embodiment of the present invention.

Referring to FIG. 3, the present invention includes a drum type washing machine 200, a first control panel 400 on the drum type washing machine 200, a dryer 300, and a second control panel 500 on the dryer 300.

The first control panel 400 includes a key part 410 for application of command for controlling the drum type washing machine or the dryer 300, a display part 420 for displaying an image in accordance with the command to the key part 410, a first case 430 for fastening the key part 410 and the display part 420 thereto, and a first controlling part (not shown) for controlling operation of a relevant appliance according to the command applied through the key part 410 or the display part 420.

Similar to the first control panel 400, the second control panel 500 includes a key part 510 for application of command for controlling the drum type washing machine 200 or the dryer 300, a display part 520 for displaying an image in accordance with the command to the key part 510, a second case 530 for fastening the key part 510 and the display part 520 thereto, and a second controlling part (not shown) for controlling operation of a relevant appliance according to the command applied through the key part 510 or the display part 520.

Figure 4:
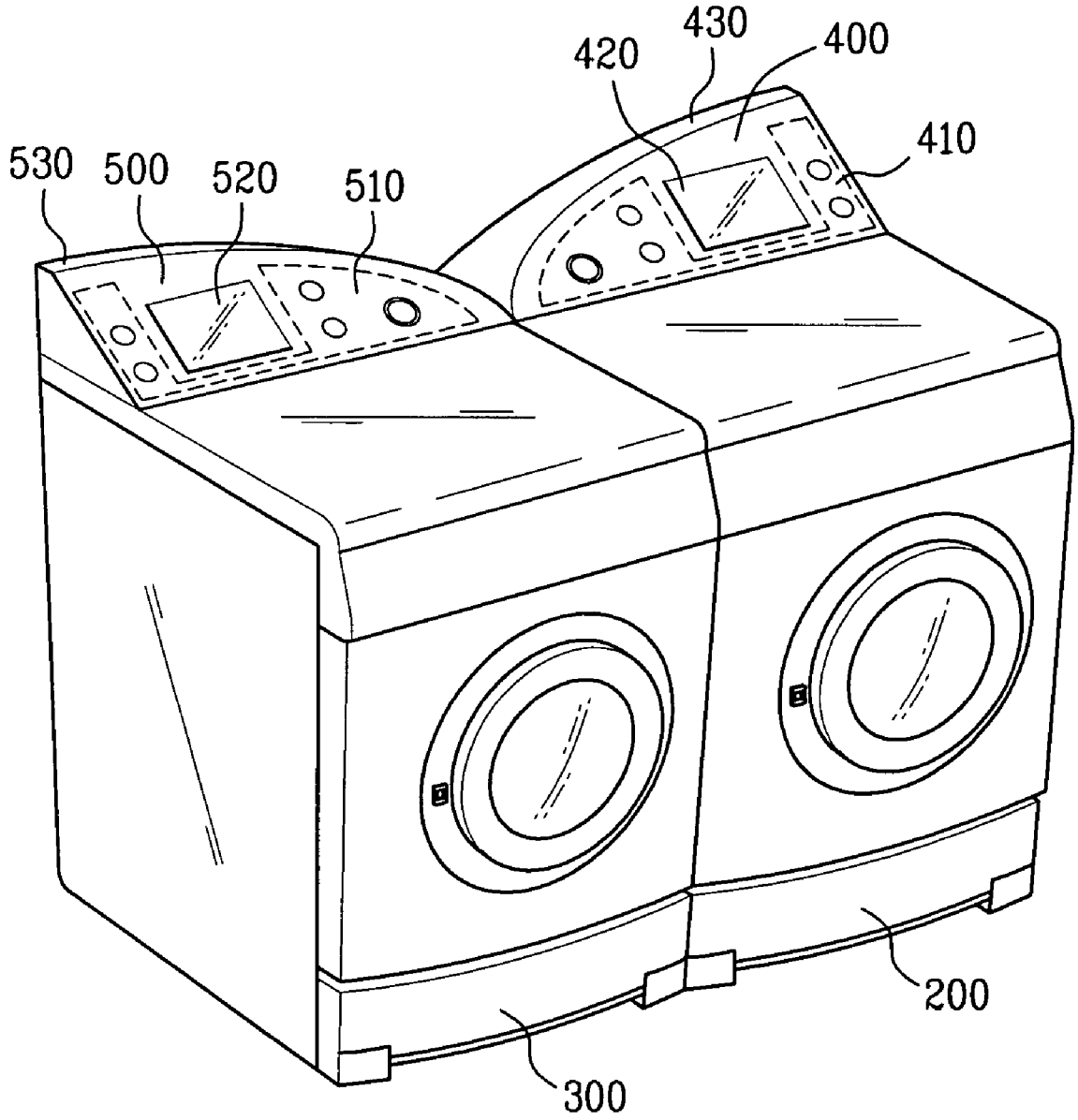
FIG. 4 illustrates a perspective view showing an example of position exchange between the drum type washing machine and the laundry dryer in FIG. 3.

Referring to FIG. 3, in this instance, the first control panel 400, and the second control panel 500 are formed symmetry. However, as shown in FIG. 4, if positions of the drum type washing machine 200 and the dryer 300 are exchanged, the drum type washing machine 200 and the dryer 300, not only have a poor outer appearance collectively, but also are liable to cause much confusion in using the drum type washing machine 200 and the dryer 300, even if the drum type washing machine and the dryer are arranged in symmetry.

Figure 5:
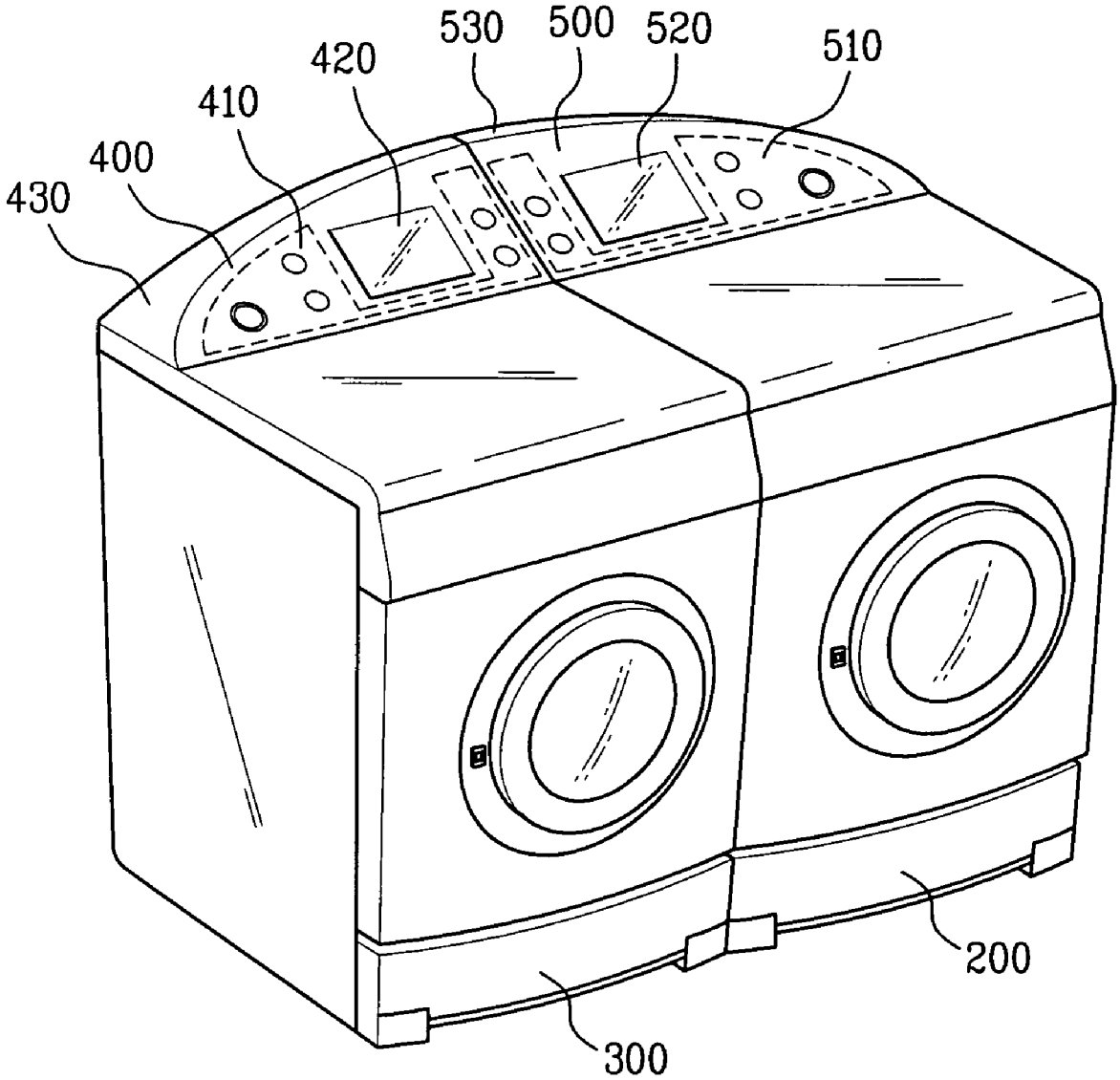
FIG. 5 illustrates a perspective view showing another example of position exchange between the drum type washing machine and the laundry dryer in FIG. 3 having positions thereof exchanged.

Therefore, as shown in FIG. 5, if it is desirable to exchange positions of the drum type washing machine 200 and the dryer 300 due to gas pipe connection or the like, positions of the drum type washing machine 200 and the dryer 300 are exchanged, and the second controlling part (not shown) is connected to the first control panel 400, and the first controlling part (not shown) is connected to the second controlling panel 500. Thus, a collective arrangement of the drum type washing machine 200 and the dryer 300 has the same outer appearance with before, always.

For an example, in a state the first control panel 400 is on the drum type washing machine 200, and the second control panel 500 is on the dryer 300, even if positions of the drum type washing machine 200 and the dryer 300 are exchanged, such that the dryer 300 comes under the first control panel 400, and the drum type washing machine 200 comes under the second control panel 500, the present invention permits that the control can still be made with the control panel on the appliance intended to control.

Preferred embodiments of the present invention will be described with reference to FIGS. 6 and 7.

First Embodiment

Parts identical to the parts in FIGS. 3 to 5 will be given the same reference symbols.

Figure 6:
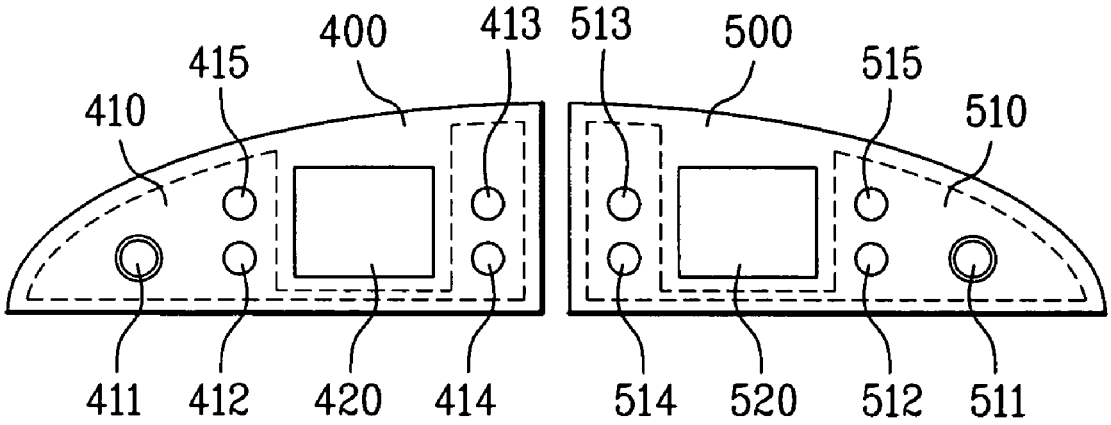
FIG. 6 illustrates a diagram of the first and second panels in FIG. 3 in accordance with a first preferred embodiment of the present invention.

Referring to FIG. 6, the control panels in accordance with a first preferred embodiment of the present invention include a first control panel 400 on a drum type washing machine 200 or a dryer 300 having a key part 410 for applying a command a user desires, and a display part 420 for displaying user's command given through the key part 410, or by user's touch thereon, and a second control panel 500 on the drum type washing machine 200 or the dryer 300 in symmetry with the first control panel 400 having a key part 510 for applying a command a user desires, and a display part 520 for displaying user's command given through the key part 510, or by user's touch thereon, in symmetry with the key part 410, and the display part 420 in the first control panel 400, respectively.

The key part 410 or 510 includes a power key 411 or 511 for applying power to the drum type washing machine 200 or the dryer 300, a start/stop key 412 or 512 for applying an operation start command or an operation stop command to the drum type washing machine or the dryer, a back key 413 or 513 for displaying an image prior to an image displayed on the display part 420 or 520 presently, a home key 414 or 514 for initializing all menu, and my favorite key 415 or 515 for selecting a course the user desires.

The display part 420 or 520 includes a touch panel 420 or 520 for displaying the command applied through the key part 410 or 510, and a menu for selecting a control operation proper to the drum type washing machine 200 or the dryer 300, and selecting the control operation for carrying out the operation.

That is, while the drum type washing machine 200 requires a menu having washing, rinsing, spinning, water level setting, time setting, and selection of different courses, since the dryer 300 requires a menu proper only to the dryer for selecting a drying time period for different drying cycles, a key system similar to the key part 410 or 510 is not employed for the menus, but the touch panel 420 or 520 is employed for displaying, selecting, processing a menu programmed already in a control board mounted on the drum type washing machine 200 or the dryer 300.

If the user presses the may favorite key 415, for example, of the drum type washing machine 200, a menu is displayed on the touch panel, the display part 420, so that the user, by mere touch thereon, selects a washing condition as desired by setting a desired course, or by retrieving, and displaying a my favorite course stored therein already, and processes a washing cycle more conveniently with reference to the displayed menu.

Second Embodiment

Figure 7:
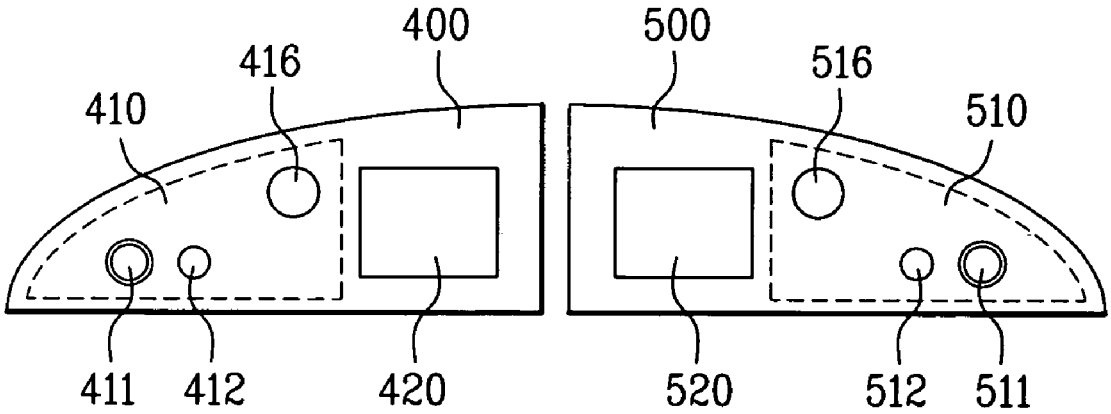
FIG. 7 illustrates a diagram of the first and second panels in FIG. 3 in accordance with a second preferred embodiment of the present invention.

Referring to FIG. 7, the control panels in accordance with a second preferred embodiment of the present invention include a first control panel 400 on a drum type washing machine 200 or a dryer 300 having a key part 410 for applying a command a user desires, and a display part 420 for displaying user's command given through the key part 410, or by user's touch thereon, and a second control panel 500 on the drum type washing machine 200 or the dryer 300 in symmetry with the first control panel 400 having a key part 510 for applying a command a user desires, and a display part 520 for displaying user's command given through the key part 510, or by user's touch thereon, in symmetry with the key part 410, and the display part 420 in the first control panel 400, respectively.

The key part 410 or 510 includes a power key 411 or 511 for applying power to the drum type washing machine 200 or the dryer 300, a start/stop key 412 or 512 for applying an operation start command or an operation stop command to the drum type washing machine or the dryer, and a dial knob 416 or 516 for the user to select desired menu or a course.

The display part 420 or 520 including a liquid display device for changing a course or a cycle displayed thereon following the course or the cycle changed as the dial knob 416, or 516 is turned, so that the user selects a desired course or cycle with reference to the course or cycle displayed thereon by pressing the dial knob 416, or 516.

As has been described, the control panels of the present invention permits the user to control the drum type washing machine and the dryer by using the control panels mounted thereon respectively more conveniently even if positions of installation of the drum type washing machine and the dryer are exchanged, and always provides a good outer appearance collectively, in a case the drum type washing machine and the dryer are installed side by side.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. Control panels for a drum type washing machine and a dryer, comprising:

a first control panel configured to be mounted on the drum type washing machine or the dryer, for controlling a cycle of the drum type washing machine or for controlling a cycle of the dryer, respectively;

a second control panel configured to be mounted on the dryer or the drum type washing machine in symmetry with the first control panel in view of an outer appearance, for controlling a cycle of the drum type washing machine or for controlling a cycle of the dryer, respectively;

a first controlling part configured to be connected to either one of the first control panel or the second control panel for controlling an operation of a corresponding one of the drum type washing machine and the dryer according to a user's command; and a second controlling part configured to be connected to either one of the first control panel or the second control panel for controlling an operation of a corresponding one of the drum type washing machine and the dryer according to a user's command, wherein the first and second control panels are interchangeably mounted on the drum type washing machine and the dryer, and wherein the first controlling part includes control commands configured to control the operation of both of the drum type washing machine and the dryer, and the second controlling part includes the control commands configured to control the operation of both of the drum type washing machine and the dryer such that the first and second control panels are interchangeably mounted on the drum type washing machine and the dryer without having to interchange the first and second controlling parts.

2. The control panels as claimed in claim 1, wherein the first and second control panels include:

a key part for a user to apply a command for controlling the operation of the drum type washing machine or the dryer; and a displaying part for displaying an image in accordance with the command applied through the key part.

3. The control panels as claimed in claim 2, wherein the key part includes key buttons for turning on and off a power, starting and stopping a cycle, moving back one option, going to a menu home option, and selecting a favorite entry.

4. The control panels as claimed in claim 2, wherein the key part includes key buttons for turning on and off a power, starting and stopping a cycle, and a dial knob for selecting various menus and cycles.

5. The control panels as claimed in claim 2, wherein the display part includes a touch panel the user can touch to select a desired menu or cycle.

6. The control panels as claimed in claim 5, wherein the touch panel displays a menu for performing an operation particular to the dryer or drum type washing machine the touch panel is mounted to.

7. The control panels as claimed in claim 2, wherein the display part includes a liquid display device (LCD).

8. The control panels as claimed in claim 2, wherein, when the user inputs the command through the key part, the corresponding operation of the drum type washing machine or the dryer is controlled.

9. The control panels as claimed in claim 1, wherein the first and second control panels are mounted on a top part of any one of the drum type washing machine and the dryer.

10. Control panels for a drum type washing machine and a dryer, comprising:

a first control panel mounted on the drum type washing machine or the dryer, and including a first key part for applying a command for controlling the drum type washing machine or the dryer, and a first display part for displaying an image in accordance with the command applied through the first key part;

a second control panel mounted on the drum type washing machine or the dryer in symmetry with the first control panel, and including a second key part for applying a command for controlling the drum type washing machine or the dryer, and a second display part for displaying an image in accordance with the command applied through the second key part, in symmetry with the first key part and the first display part in the first control panel respectively; and first and second controlling parts interchangeably connected to either one of the first and second control panels, and for controlling an operation of the respective drum type washing machine or dryer according to the command of the user applied through the corresponding first control panel or the second control panel, and wherein the first controlling part includes control commands configured to control the operation of both of the drum type washing machine and the dryer, and the second controlling part includes the control commands configured to control the operation of both of the drum type washing machine and the dryer such that the first and second control panels are interchangeably mounted on the drum type washing machine and the dryer without having to interchange the first and second controlling parts.

* * * * *